US007530799B2

(12) United States Patent
Smith

(10) Patent No.: US 7,530,799 B2
(45) Date of Patent: May 12, 2009

(54) LONG-STROKE DEEP-WELL PUMPING UNIT

(75) Inventor: Norris Edward Smith, 108 February La., Lufkin, TX (US) 75904

(73) Assignee: Norris Edward Smith, Lufkin, TX (US)

( * ) Notice: Subject to any disclaimer, the term of this patent is extended or adjusted under 35 U.S.C. 154(b) by 849 days.

(21) Appl. No.: 10/903,574

(22) Filed: Jul. 30, 2004

(65) Prior Publication Data

US 2006/0024171 A1 Feb. 2, 2006

(51) Int. Cl.
*F04B 9/10* (2006.01)
*E21B 34/10* (2006.01)

(52) U.S. Cl. ..... 417/390; 417/904; 166/72; 60/382

(58) Field of Classification Search ..... 417/390, 417/555.2, 904; 166/72; 92/381, 382
See application file for complete search history.

(56) References Cited

U.S. PATENT DOCUMENTS 1,588,784 A 6/1926 Trout
1,979,675 A 11/1934 Croom
3,029,650 A 4/1962 Byrd
3,248,958 A 5/1966 Bender
3,345,950 A 10/1967 Bender
3,483,828 A 12/1969 Bender
3,807,902 A * 4/1974 Grable et al. ..... 417/46
4,187,680 A * 2/1980 Sanford ..... 60/369
4,197,766 A * 4/1980 James ..... 74/89.2
4,226,404 A * 10/1980 Zens ..... 254/359
4,474,002 A 10/1984 Perry
4,505,162 A 3/1985 Hoh et al.
4,761,120 A * 8/1988 Mayer et al. ..... 417/403
4,916,959 A 4/1990 Lively
5,018,350 A * 5/1991 Bender ..... 60/369
5,027,666 A * 7/1991 Filicetti ..... 74/37
5,246,076 A 9/1993 Watson
5,252,031 A 10/1993 Gibbs
5,281,100 A 1/1994 Diederich
5,481,873 A 1/1996 Saruwatari et al.
5,743,716 A 4/1998 Smith

OTHER PUBLICATIONS

Randal Klimitchek and Karl Sakocius, *Integrated Rod-Pump Controller Cuts Operating Costs*, Petroleum Technology Digest For Independent Producers, Oct. 2003, 2 pages.

Baker Hughes Centrilift Intelligent Pumping Systems, printed from http://ww.bakerhughes.com/centrilift/specsys/IPS._htm on Aug. 11, 2004, 5 pages.

*The Rotaflex® Advantage*, p. 31, printed from http://www.weatherford.com/weatherford/groups/public/documents/general/wft000802.pdf on Feb. 18, 2005.

(Continued)

*Primary Examiner*—Charles G Freay
(74) *Attorney, Agent, or Firm*—Patterson & Sheridan, L.L.P.

(57) ABSTRACT

Methods and apparatus for driving a positive displacement pump disposed within a wellbore are disclosed herein. Embodiments of the present invention provide a drive mechanism for driving the downhole positive displacement pump. In embodiments of the present invention, the positive displacement pump is hydraulically driven and mechanically counterbalanced. The drive mechanism may be mechanically or electrically controlled, or may be controlled by a combination of mechanical and electrical controls.

48 Claims, 6 Drawing Sheets

OTHER PUBLICATIONS

*Reciprocating Rod Lift Systems*, Weatherford Artifical Lift Systems, 1999, 2 pages.

*Measurement Report For: Stearns 276*, Torch Energy Co., 1997 Theta Enterprises, Inc., 1 page.

Allan Rosman and Michael Nofal, *Computer Controlled Pump Unit Cuts Power, Increases Output*, Oil and Gas News, 1996, 3 pages.

*Rotaflex® Long Stroke Pumping Units*, Weatherford Artifical Lift Systems, Apr. 2002, 4 pages.

*Reciprocating Rod Lift Pumping Units*, Weatherford Artificial Lift Systems, 22 pages, printed from http://www.weatherford.com/weatherford/groups/public/documents/general/wft003549.pdf on Feb. 18, 2005.

*Rotaflex® Long-Stroke Pumping Units*, Weatherford Artifical Lift Systems, 17 pages, printed from http://www.weatherford.com/weatherford/groups/public/documents/artificiallift/1 on Feb. 18, 2005.

*Sauer Danfoss Series 90*, Sauer-Danfoss Company, Mar. 1999, 64 pages.

* cited by examiner

LONG-STROKE DEEP-WELL PUMPING UNIT

BACKGROUND OF THE INVENTION

1. Field of the Invention

Embodiments of the present invention generally relate to a reciprocating positive displacement pump utilized downhole within a wellbore to pump production fluid to a surface of the wellbore. More specifically, embodiments of the present invention relate to a drive mechanism for the downhole positive displacement pump.

2. Description of the Related Art

To obtain hydrocarbon fluids from an earth formation, a wellbore is drilled into the earth to intersect an area of interest within a formation. Upon reaching the area of interest within the formation, artificial lift means is often necessary to carry production fluid (e.g., hydrocarbon fluid) from the area of interest within the wellbore to the surface of the wellbore. Some artificially-lifted wells are equipped with sucker rod lifting systems.

Sucker rod lifting systems generally include a surface drive mechanism, a sucker rod string, and a downhole positive displacement pump. Fluid is brought to the surface of the wellbore by reciprocating pumping action of the drive mechanism attached to the rod string. Reciprocating pumping action moves a traveling valve on the positive displacement pump, loading it on the down-stroke of the rod string and lifting fluid to the surface on the up-stroke of the rod string. A standing valve is typically located at the bottom of a barrel of the pump which prevents fluid from flowing back into the well formation after the pump barrel is filled and during the down-stroke of the rod string.

The rod string of the sucker rod lifting system either includes several rods connected together or one continuous rod. Regardless of its make-up, the rod string provides the mechanical link of the drive mechanism at the surface to the positive displacement pump downhole. The typical rod string is constructed from steel or some other elastic material.

To access hydrocarbon fluid within a well, it is often necessary to drill a wellbore to a high depth within the formation, often termed a "deep well." Pumping fluid from deep wells using a sucker rod lifting system is problematic for several reasons. First, the downhole positive displacement pump is submerged in the downhole fluid so that the positive displacement pump may fill with the surrounding production fluid upon reciprocation of the rod string, and because the fluid level of a deep well is typically located at a high depth within the wellbore, the rod string which connects the positive displacement pump to the drive mechanism must be long to access the fluids. A rod string of more than 10,000 feet is not uncommon. Therefore, the high length of the rod string as well as the material which makes up the rod string causes the rod string to weigh a large amount.

Additionally, the stroking motion of the rod string must be long to reduce the number of strokes required to displace the production fluid. The length of the motion of the rod string and the weight of the rod string cause the rod string to possess a high momentum at the end of the up-stroke and down-stroke, often causing the rod string to deform or break when motion is stopped between the up-stroke and down-stroke (at the "turnaround"). Specifically, the elastic nature of the material of which the rod string is constructed makes the rod string vulnerable to rod stretch, especially at the turnaround between the down-stroke and the up-stroke where the momentum of the rod string is most difficult to stop. Moreover, the stresses imposed on the rod string by a mismatch between the dynamic characteristics of the surface drive unit and the rod string may cause the rod string to break. This is particularly true when the rod string bounces up and down when attempting to switch the direction of the rod string at turnarounds between the up-stroke and down-stroke. Generally, rod string motion problems include premature rod string separation due to material fatigue, damage to the well tubing in which the rod string reciprocates and instantaneous rod string loads beyond the design limit due to suddenly applied loads from dynamic mismatch.

The downhole pump efficiency is affected by unfavorable rod string motion in other ways. A downhole pump needs time at the bottom of each stroke to fill with fluid and time at the top of each stroke to unload the fluid. Otherwise, the pump may cycle only partially filled. Rod string motion problems, including rod string damage, tubing damage, and only partial filling of the pump, increase as the load on and speed of the rod string are increased.

Sucker rod lifting systems include the additional problem when the well is pumped down to the point where fluid only partially fills the downhole pump barrel during the up-stroke of the rod string. On the next down stroke, the rod string, including the weight of the rod string and the fluid column, crashes into the partially-filled pump barrel and upon the standing valve. This crashing of the rod string is often termed "fluid pounding." The condition at which fluid pounding occurs must be detectable by some kind of monitoring system to relay the condition to pump controls.

Another problem with deep-well sucker rod lifting systems is that the difference between the loading on the rod string during the up-stroke and the loading on the rod string during the down-stroke is severe. The load on the rod string during the up-stroke is much larger than the load on the rod string during the down-stroke because the drive mechanism must lift the hydrocarbon fluid from the wellbore on the up-stroke and must also contend with gravitational forces acting downward on the rod string while lifting the rod string for the up-stroke. In contrast, gravity aids the rod string motion during the down-stroke by acting in the same direction in which the rod string is moving, and fluid is not lifted, eliminating the additional weight of the fluid. This uneven loading requires a massive amount of horsepower for the drive mechanism to lift the rod string on the up-stroke, while limited horsepower is necessary for the rod string to fall into the wellbore on the down-stroke. Uneven loading in deep well pumps constitutes an inefficient use of horsepower because of the high amount of work expended in moving the rod string upward which is then not recovered upon the rod falling downward. Ideally, the rod load is evenly divided between the up-stroke and down-stroke of the pumping cycle to increase the efficiency of power use in the pumping unit.

FIG. 5A illustrates the rod string motion in graphical form for one drive mechanism currently used to cycle a rod string through and between the up-stroke and down-stroke, the crank and beam unit. Specifically, FIG. 5A shows a typical rod string motion graph for a crank and beam pump mechanical drive mechanism. The crank and beam pump mechanical drive mechanism articulates the rod string upward and downward within the downhole cylinder with a crank. The crank produces the sinusoidal rod string motion profile shown in FIG. 5A.

As shown in FIG. 5A, the turnaround point between the up-stroke and the down-stroke is at point T. The inter-cycle speed of the rod string during the up-stroke and down-stroke is sinusoidal and not constant, as indicated by the slope of the line representing the up-stroke and the down-stroke. Namely, the rod string moves at an uneven speed on the up-stroke and repeats the up-stroke motion on the down-stroke.

Dyno-card loading graphs illustrate loading on the rod string during a cycle, which includes the up-stroke, down-stroke, and turnarounds of the rod string between the up-stroke and down-stroke. The dyno-card graph represents load on the rod string versus position of a defined point on the rod string with respect to a defined point within or above the wellbore. Referring specifically to FIG. 6A, which is the dyno-card profile of the beam pump drive mechanism, the upper line between points J and K represents the loading on the rod string during the up-stroke, while the lower line between points J and K represents the loading on the rod string during the down-stroke. Points J and K represent the turnaround points of the rod string from the down-stroke to the up-stroke and from the up-stroke to the down-stroke, respectively.

The loading on the rod string is very erratic, as evidenced by the loading profile on the dyno-card graph. From point J to point K during the up-stroke, the rod string loading drastically increases to point P, then drastically decreases to point Q, only to increase and decrease again between points Q and K. The loading on the rod string at point P, which is the highest load on the rod string in this dyno-card profile, is higher than is healthy for the rod string. Similarly erratic, on the down-stroke, the loading drastically decreases to point R from point K, then increases to point S, then decreases again before increasing back to point J. This erratic loading on the rod string often stretches, breaks, or otherwise damages the rod string. Additionally, this erratic loading does not make efficient use of the horsepower which drives the drive mechanism.

Another drive mechanism explored for cycling the rod string through and between the up-stroke and the down-stroke is a gear-driven mechanical drive system having a mechanical counterbalance. As is shown in FIG. 5B, the mechanical drive system induces constant rod string motion except at the turnaround point T, so that inter-cycle speed is the same over the entire up-stroke as well as the entire down-stroke. Because the slopes of the lines on each side of the turnaround point T are not as severe as the slopes of the lines on either side of the turnaround point T of FIG. 5A, the inter-cycle speed of the rod string is lower for the system of FIG. 5B than for the system of FIG. 5A.

Despite the decrease in inter-cycle speed, the mechanical drive system with the mechanical counterbalance is generally an improvement over the crank and beam pump drive mechanism because of the more favorable loading profile evidenced in the dyno-card graph of FIG. 6B. The loading on the rod string does not erratically vary with position of the rod string; in fact, the loading on the rod string is nearly constant on the upstroke, which is generally from point L to point M and nearly constant on the down-stroke, which is generally from point N to point O. The turnaround point between the up-stroke and down-stroke is between points M and N, while the turnaround point between the down-stroke and the up-stroke is generally between points O and L.

While the inter-cyclic speed is good for this drive mechanism, as is evidenced by the favorable rod string motion profile shown in FIG. 5B, the loading on the rod string at the turnarounds of the rod string is not desirable. The undulations on the lines of FIG. 6B to the immediate right of the point L and to the immediate left of the point N represent the jarring which the rod string experiences at the abrupt stopping of motion and abrupt beginning of motion in the opposite direction of the rod string at the turnarounds. The jarring of the rod string also causes damage to the rod string, which may include breaking or stretching of the rod string. The amount of time the rod string spends at the top and the bottom of the stroke is not long enough to produce a good, smooth turnaround.

In gear-driven mechanical drive mechanisms, an electric motor rotates a gear reducer, and the gear reducer restricts the load and speed capacity of the mechanical drive mechanism. A problem with the mechanically-driven pumping units is that gear-driven pumping units are not very responsive to speed changes of the polished rod. Gear-driven pumping units possess inertia from previous motion so that it is difficult to stop the units or change the direction of rotation of the units quickly. Therefore, jarring (and resultant breaking/stretching) of the rod string results upon the turnaround unless the speed (strokes/minute) of the rod string during the up-stroke and down-stroke is greatly decreased at the end of the up-stroke and down-stroke, respectively. Gear-driven pumping units also are not sufficiently responsive to speed changes because of the tendency of the belts to burn up at abrupt speed changes and at high speeds and the torque limitations of gear reducers present in these systems. Decreasing of the speed of the rod string for such a great distance of the up-stroke and down-stroke decreases the speed of fluid pumping, thus increasing the cost of the well.

There is a need for a drive mechanism for a sucker rod positive displacement pump which efficiently uses horsepower provided to the drive mechanism. There is a further need for a drive mechanism which controls loading on the rod string to reduce rod string damage and to increase the amount of fluid volume pumped by the downhole pump. There is a yet further need for a drive mechanism which controls loading on the rod string during turnarounds between the up-stroke and the down-stroke, and vice versa. Finally, there is a need for a drive mechanism which is sufficiently responsive to alter the speed of motion of the rod string quickly.

SUMMARY OF THE INVENTION

In one aspect, embodiments of the present invention include a drive mechanism for a downhole positive displacement pump, comprising a hydraulic drive comprising a variable flow hydraulic pump operatively connected to a reversible drive motor with a closed-loop, hydraulic circuit; and a reciprocating counterbalance, wherein the hydraulic drive is capable of dictating the pumping rate of the downhole positive displacement pump and the reciprocating counterbalance is capable of balancing a load on a rod string of the positive displacement pump and the drive mechanism.

In another aspect, embodiments of the present invention provide a method of driving a downhole positive displacement pump, comprising providing a drive mechanism comprising a hydraulic drive having a closed-loop hydraulic circuit; providing the downhole positive displacement pump comprising a piston reciprocatable within a cylinder, wherein the hydraulic drive is operatively connected to the piston; operating the hydraulic drive to pump downhole fluid using the positive displacement pump; counterbalancing a load of the downhole fluid and the piston using a reciprocating counterbalance; and controlling the speed and direction of reciprocation of the piston within the cylinder using the drive mechanism.

In yet another aspect, embodiments of the present invention include a drive mechanism for a downhole, reciprocating positive displacement pump, comprising a hydraulic drive comprising a pump operatively connected to a reversible, variable-speed electric motor; and a reciprocating counterbalance, wherein the hydraulic drive is capable of dictating the pumping rate of the downhole positive displacement pump and the reciprocating counterbalance is capable of balancing a load on a rod string of the downhole positive displacement pump and the drive mechanism. Embodiments of the present invention also include a drive mechanism for a downhole, reciprocating positive displacement pump, comprising a hydraulic drive comprising a variable flow hydraulic pump operatively connected to a reversible, variable-speed electric motor; and an accumulator, wherein the hydraulic drive is capable of dictating the pumping rate of the downhole positive displacement pump and the accumulator is capable of balancing a load on a rod string of the downhole positive displacement pump and the drive mechanism.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention include a drive mechanism including a highly responsive hydraulic drive motor driven with a closed loop hydraulic circuit. The responsiveness of the hydraulic drive motor results because the closed loop hydraulic circuit works on both sides of the hydraulic drive motor to power one side of the motor and brake one side of the motor when there is a need to stop rotation of the hydraulic drive motor suddenly. Additionally, the hydraulic drive motor is highly responsive to speed changes because of the lack of revolving parts in the drive mechanism, as revolving parts in a mechanical drive mechanism are difficult to quickly reduce in speed or stop because of inertia.

Figure 1:
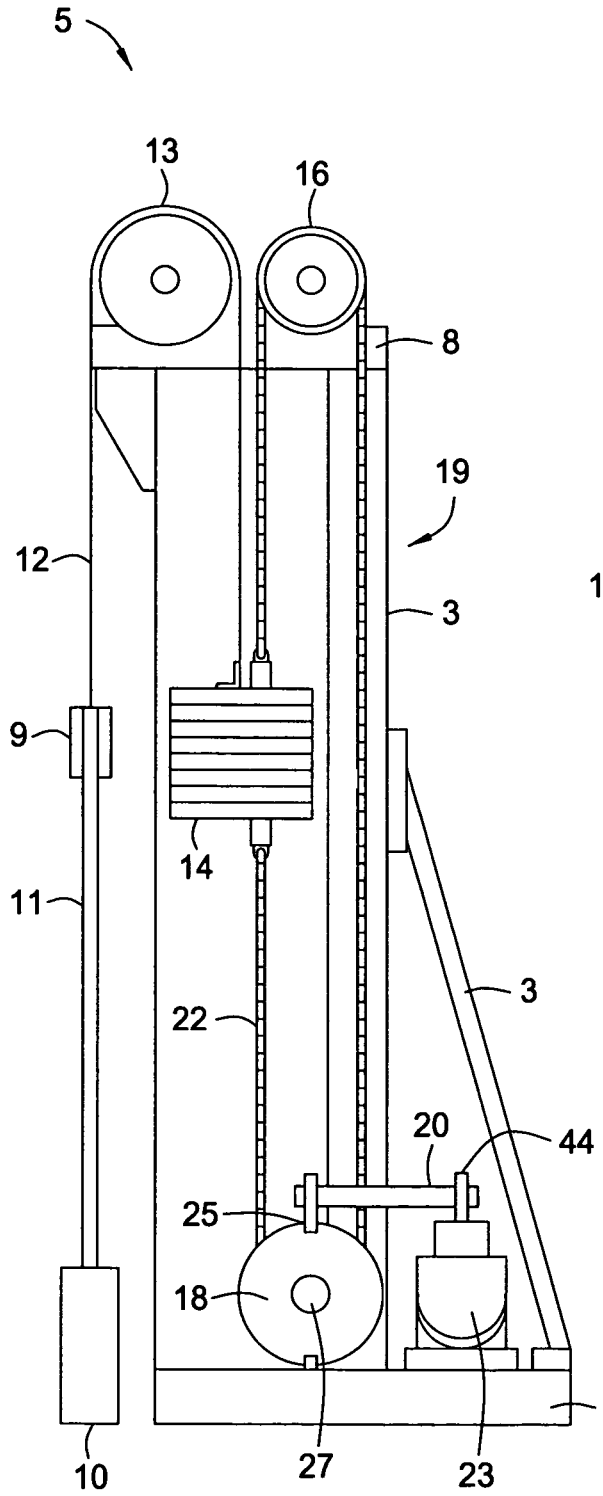
FIG. 1 is a side view of a drive mechanism for a positive displacement pump.
Figure 2:
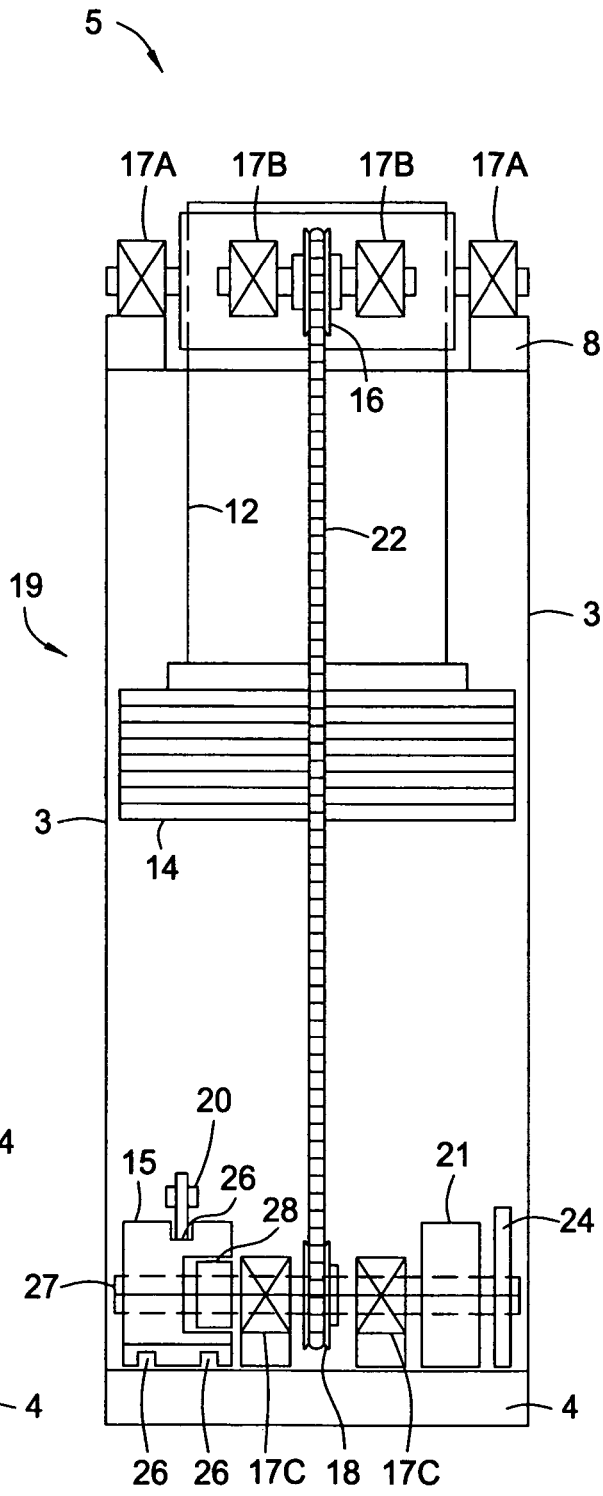
FIG. 2 is a front view of the drive mechanism of FIG. 1.

FIGS. 1 and 2 show side and front views, respectively, of a drive mechanism 5 used to drive a positive displacement pump (not shown) from a surface of a wellbore (not shown). The drive mechanism 5 is preferably disposed at least partially within a tower 19 having a base frame 4 connected by one or more beams 3 to a platform 8. The positive displacement pump is preferably a plunger pump or sucker rod pump and is located downhole within the wellbore. The wellbore, which is a bore drilled within an earth formation for conveying hydrocarbons, is located below and within a wellhead 10 disposed at the surface of the wellbore.

The positive displacement pump is used to pump reservoir fluid such as hydrocarbons, or combinations of water and hydrocarbons, from within the wellbore to the surface of the wellbore. To this end, the positive displacement pump is placed within fluid within the wellbore. A rod string including a polished rod 11 is disposed within a cylinder (not shown) of the positive displacement pump to act as a piston upon upward and downward movement within the cylinder. The positive displacement pump is a one-way positive displacement pump which lifts fluid on the rod string up-stroke and refills with fluid on the rod string down-stroke. The drive mechanism 5 is used to cycle the positive displacement pump to lift production fluid (preferably hydrocarbons or combinations of water and hydrocarbons) from within the wellbore.

The polished rod 11, part of the rod string portion of the positive displacement pump, extends through the wellhead 10 as well as above and below the wellhead 10. The polished rod 11 is connected to the drive mechanism 5 by a hanging mechanism 9. Specifically, the hanging mechanism 9 rigidly connects an upper end of the polished rod 11 to a first end of at least one first strapping member, preferably one or more lift belts 12, of the drive mechanism 5. The first strapping member may in the alternative include one or more chains.

The lift belt 12 is wound over the top of a lift pulley 13 and is operatively connected to an upper end of a counterbalancing member, such as a counterweight 14, at a second end. The lift pulley 13 is operatively connected to the platform 8 by one or more bearings mechanisms 17A, as shown in FIG. 2. The one or more bearings mechanisms 17A allow the lift pulley 13 to rotate relative to the platform 8. The lift belt 12 is moveable around the lift pulley 13 to lower the polished rod 11 by raising the counterweight 14 or to raise the polished rod 11 by lowering the counterweight 14.

The counterweight 14 includes one or more reciprocating weights which counterbalance the load of the rod string. Weight may be added or removed from the counterweight 14 as needed to counterbalance the load of the rod string weight (on the rod string up-stroke and down-stroke) and/or the downhole fluid weight (when the rod string lifts fluid on the up-stroke). Preferably, the load of the rod string is considered counterbalanced when the counterweights are approximately equal to the rod string weight plus approximately one half of the fluid column weight. The counterbalance 14 advantageously reduces the volume and pressure of hydraulic fluid utilized in the operation of the drive mechanism 5, as described below.

Also operatively connected to the counterweight 14 is at least one second strapping member, preferably one or more chains 22. A first end of the chain 22 is operatively connected to an upper end of the counterbalance 14, so that the second end of the lift belt 12 is connected to the counterbalance 14 closer in proximity to the polished rod 11 than the first end of the chain 22. Additionally, a second end of the chain 22 is operatively connected to a lower end of the counterbalance 14. The first and second ends of the chain 22 are connected to the counterbalance 14 substantially in line with one another. In an alternate embodiment of the present invention, one or more gear belts may be utilized in lieu of the one or more chains 22.

The chain 22 is moveable around an idle sprocket 16 and a drive sprocket 18, which are substantially coaxial with one another. The idle sprocket 16 is operatively connected to the platform 8 by one or more bearings mechanisms 17B which allow the idle sprocket 16 to rotate relative to the platform 8. In an alternate embodiment of the present invention, the idle sprocket 16 may be operatively connected to an additional platform (not shown) above, adjacent to, or below the platform 8 on which the lift pulley 13 is located by one or more bearings mechanisms.

The drive sprocket 18 is operatively connected to the base frame 4 by one or more bearings mechanisms 17C. The one or more bearings mechanisms 17C allow the drive sprocket 18 to rotate relative to the base frame 4 by a drive shaft 27 extending through the bearings mechanisms 17C and through the drive sprocket 18.

The drive shaft 27, in addition to extending through the drive sprocket 18, extends through a drive motor 21. The drive motor 21 provides the rotational force to rotate the drive shaft 27 as well as other members of the drive mechanism 5 through which the drive shaft 27 extends. Referring primarily to FIG. 2, in addition to the drive motor 21, the drive shaft 27 extends through and rotates a rotating drum 15, a gear reducer 28, and a brake 24, all of which are thus substantially co-axial with one another as well as substantially co-axial with the drive sprocket 18 and drive motor 21. The one or more bearings mechanisms 17C permit the drive shaft 27 to rotate relative to the base frame 4, thereby allowing the rotating drum 15, gear reducer 28, drive motor 21, and brake 24 to rotate relative to the base frame 4.

In the preferred embodiment shown, on one side of the drive sprocket 18, the drive motor 21 and brake 24 are located in line with the drive sprocket 18, with the drive motor 21 closest to the drive sprocket 18 and the brake 24 farthest from the drive sprocket 18. On the other side of the drive sprocket 18, the gear reducer 28 and rotating drum 15 are located in line with the drive sprocket 18, with the gear reducer 28 disposed closest to the drive sprocket 18 and the rotating drum 15 located farthest from the drive sprocket 18. Other configurations and location orders of the components of the drive mechanism 5 rotatable by the drive shaft 27 are contemplated in embodiments of the present invention.

As mentioned above, the drive motor 21 rotates the drive shaft 27, thereby rotating the drive sprocket 18, brake 24, and control drum 15. The brake 24 stops rotation of the drive shaft 27 and functioning of the drive mechanism 5, for example if an emergency occurs or if unsafe conditions are encountered which necessitate the need to halt operation of the system.

The drive motor 21 may be a rotary piston, vane, or gear drive motor, and is preferably a high torque, slow speed, reversing motor which responds to hydraulic pump 23 (see below) fluid flow rate and directional changes. The gear reducer 28 reduces the amount of revolutions the rotating drum 15 must make relative to the amount of revolutions traveled by the brake 24, drive motor 21, and drive sprocket 18 during a controlled cycling of the polished rod 11. As shown, the gear reducer 28 may be housed within the rotating drum 15. Preferably, the gear reducer 28 causes the rotating drum 15 to rotate approximately 270 degrees in a direction on the up-stroke of the polished rod 11 and, conversely, approximately 270 degrees in the opposite direction on the down-stroke of the polished rod 11.

Figure 3:
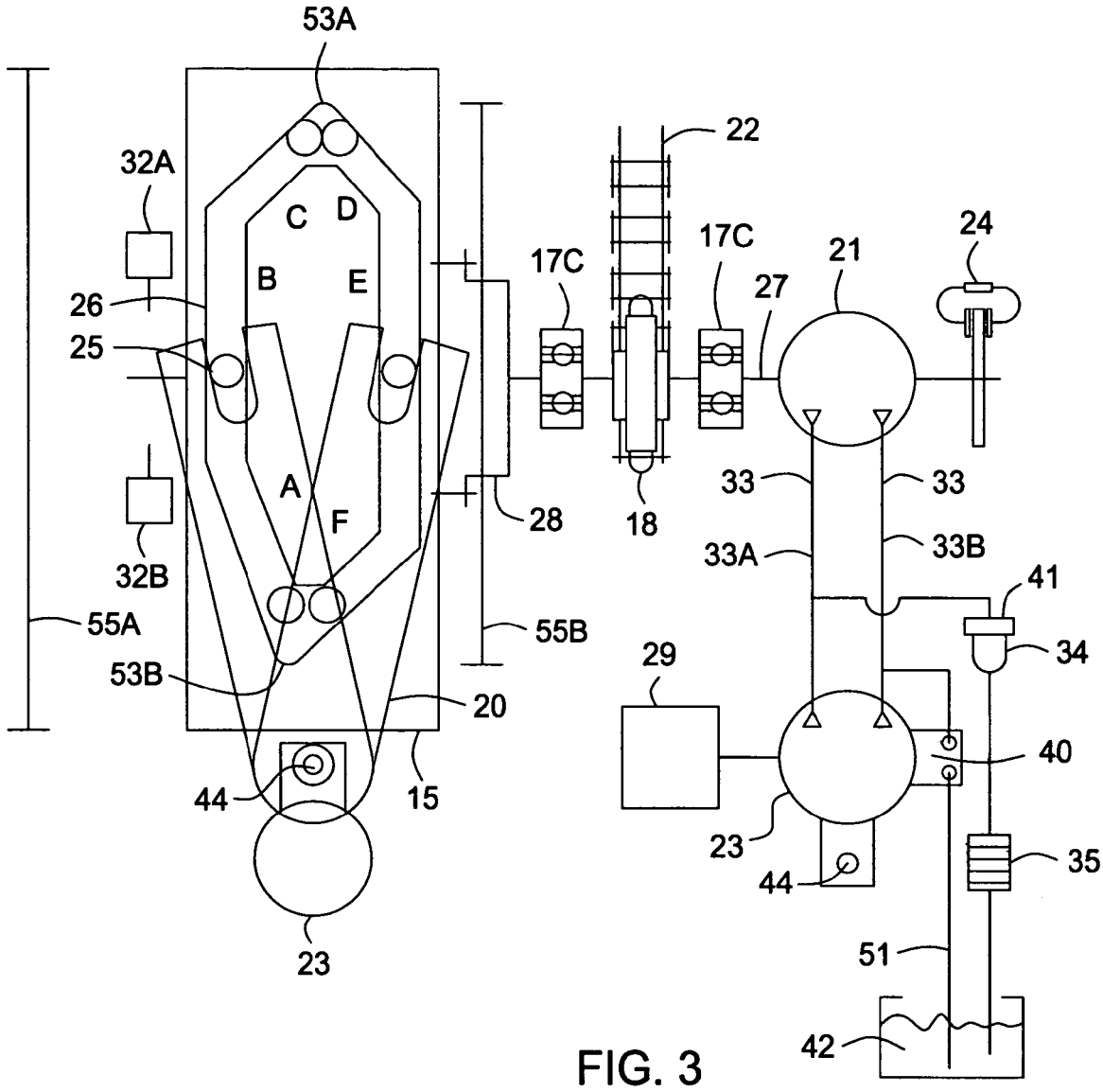
FIG. 3 is a perspective view of a portion of a mechanical control system for the drive mechanism of FIGS. 1-2.

Referring now to FIG. 1, a variable-speed hydraulic pump 23 is disposed on the base frame 4 across from and substantially in line with the rotating drum 15. As shown in FIG. 3, the hydraulic pump 23 ultimately drives the drive motor 21 using a hydrostatic, closed-loop hydraulic circuit 33 which includes at least two hydraulic lines 33A and 33B. Fluid to power the drive motor 21, which is supplied by the hydraulic pump 23, travels in two directions around the closed loop circuit 33. The hydraulic drive motor 21, therefore, is reversible to reverse the direction of the chain 22, thereby reversing the direction of the polished rod 11.

A hydraulic pump usable as the hydraulic pump 23 and having a closed-loop hydraulic circuit is shown and described in the Sauer Danfoss Series 90 Axial Piston Pumps Technical Information catalogue, which is herein incorporated by reference in its entirety. Specifically, on page 6 of the Sauer Danfoss Series 90 catalogue, FIG. 1 shows a system circuit description of a hydrostatic transmission using a series 90 axial piston variable displacement Sauer Danfoss pump with a swash plate piston or a Rineer 125 series high torque reversible vane motor, with the working loop having high pressure and the working loop having lower pressure. On page 7 of the catalogue, a sectional view of the variable displacement pump is shown in FIG. 2. When incorporating the figures in the catalogue into embodiments of the drive mechanism 5 of this application, the reversible variable displacement pump represents the hydraulic pump 23, the input shaft represents a pump control shaft 44 (described in more detail below), the fixed displacement rotary motor represents the drive motor 21, the output shaft represents the drive shaft 27, and the high pressure and lower pressure loops, along with the other fluid lines illustrated, represent the closed loop circuit 33 and the hydraulic fluid lines 33A and 33B therein.

Referring specifically to FIG. 3, the hydraulic pump 23 is powered by a powering mechanism 29 operatively connected thereto, which may be any form of power, including one or more windmills or a type of electric power such as an electric motor. The powering mechanism 29 and hydraulic pump 23 are preferably capable of rotating in only one direction (the same direction for both the powering mechanism 29 and the hydraulic pump 23) at constant speeds, while the drive motor 21 is capable of rotating in both directions to reciprocate the polished rod 11 alternately up and down within the wellbore and at variable speeds, as determined by the flow rate and direction of hydraulic fluid flowing from the hydraulic pump 23 to the drive motor 21 through the hydraulic lines 33A and 33B. Preferably, the hydraulic drive is rotary rather than linear, thus avoiding the problems which may result from debris contaminating a linear piston/cylinder drive unit.

Fluid is supplied to the closed loop circuit 33 by one or more fluid supply lines 51. A fluid supply pump 40 pumps fluid from a fluid tank 42 into the fluid supply lines 51. Fluid is purged from the closed loop circuit 33 using one or more purge fluid lines 41. In one embodiment, the fluid purged from the closed loop circuit 33 is recycled into the fluid tank 42 by treating the fluid with one or more fluid filters 34 and cooling the fluid using one or more fluid coolers 35 prior to the fluid entering the fluid tank 42.

The hydraulic pump 23 has a pump control shaft 44 operatively connected thereto for controlling the speed of the fluid entering the drive motor 21 from the hydraulic pump 23, ultimately controlling the inter-cyclic speed of the polished rod 11. The pump control shaft 44 is manipulated by a mechanical or electrical control system, or by a combination of mechanical and electrical controls. The control system controls the inter-cycle speed of the polished rod 11 (the speed of the polished rod 11 during the up-stroke or the down-stroke), thus controlling the nature and severity of the turnaround of the polished rod 11 (the transition point of the polished rod 11 between the up-stroke and down-stroke).

When using a mechanical control system, as shown in FIGS. 1-3, FIG. 3A, and FIG. 3B, a cam roller groove 26 is formed in the rotating drum 15 and extends around a portion of the rotating drum 15. The rotating drum 15 is shown in a flattened condition in FIG. 3 to illustrate the cam roller groove 26, while only an upper portion of the rotating drum 15 is shown in a flattened condition in FIG. 3B. The cam roller groove 26 is shaped in a predetermined pattern and curved at predetermined angles to create a motion profile for the polished rod 11 to cause the polished rod 11 to travel upward and downward during the up-stroke and down-stroke at predetermined inter-cyclic speeds. A cam roller 25 travels through the cam roller groove 26 in the predetermined pattern of the cam roller groove 26 as the rotating control drum 15 rotates.

Referring now to FIGS. 1, 3, 3A, and 3B, the cam roller 25 is operatively connected to the pump control shaft 44 by a pump control lever 20. The pump control lever 20 is pivotably mounted to an upper surface of the pump control shaft 44 to allow the pump control lever 20 to move left and right within the cam roller groove 26 in the rotating drum 15 during the operation (most easily seen in FIGS. 3 and 3B). The movement of the pump control lever 20 through the cam roller groove 26 controls the fluid flow rate outputted by the hydraulic pump 23, thereby controlling the speed of rotation of the drive motor 21. The speed of rotation of the drive motor 21 is thus directly correlated to the angle of the cam roller groove 26 within the rotating drum 15. Additionally, the movement of the pump control lever 20 through the cam roller groove 26 controls the direction of rotation of the drive motor 21, thereby controlling the direction of rotation of the drive sprocket 18 and ultimately of the polished rod 11 (the direction being up or down). The direction of rotation of the drive motor 21 is controlled by whether the rotating drum 15 moves upward or downward, which is dictated by the direction at which the pump control lever 20 must move through the cam roller groove 26 to exit one of the turnaround points 53A, 53B in the cam roller groove 26 (see FIG. 3).

The cam roller 25 preferably moves through the cam roller groove 26 in the same direction continuously, as dictated by a solenoid mechanism 52. Referring to FIG. 3, the solenoid mechanism 52 acts as an assist to force the pump control lever 20 to move from a steady state position within the cam roller groove 26 over center at the turnaround points 53A, 53B or into an inter-cyclic portion 55A, 55B of the cam roller groove 26 from a turnaround point 53A, 53B, thereby beginning the movement of the rotating drum 15 (and thus the polished rod 11) in a direction upward or downward. Although a solenoid mechanism 52 is described herein as the assist for moving the pump control lever 20 within the cam roller groove 26, other assist mechanisms may be utilized in the control system instead of or in addition to the solenoid mechanism. Also, the solenoid mechanism shown and described herein is a double solenoid mechanism, but a single solenoid mechanism is also contemplated for use with the embodiments shown in FIGS. 1-3B. Any solenoid mechanism known to those skilled in the art may be utilized in embodiments of the present invention.

Figure 3A:
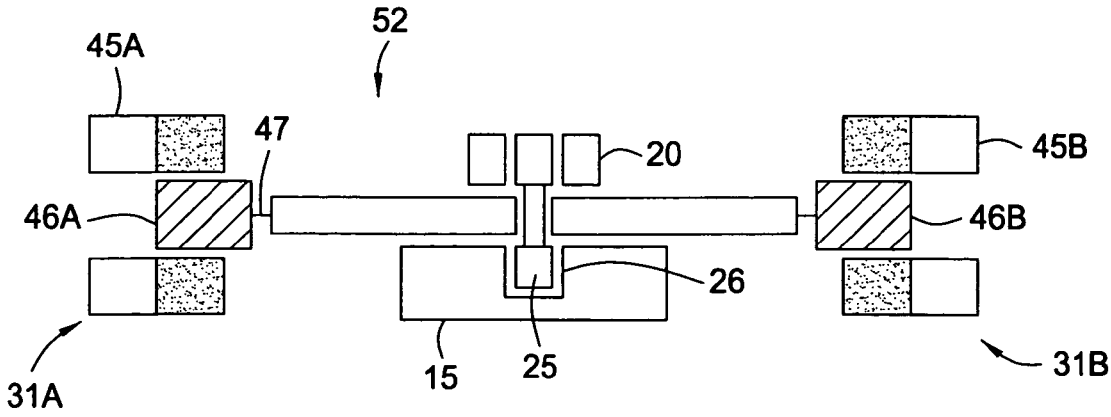
FIG. 3A is a cross-sectional view of a portion of the mechanical control system of FIG. 3.
Figure 3B:
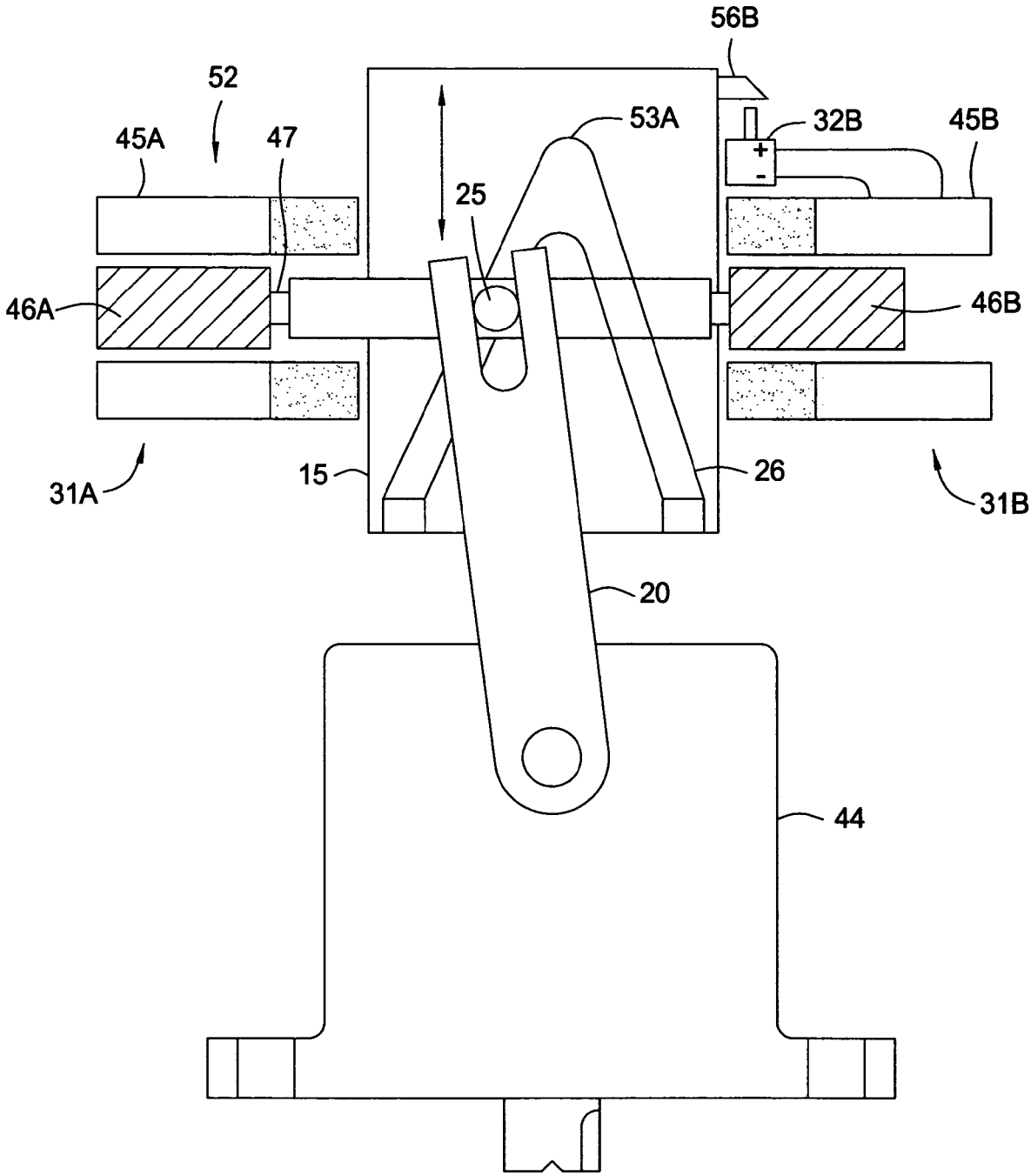
FIG. 3B is a section view of a portion of the mechanical control system of FIG. 3.

As shown in FIGS. 3A and 3B, the solenoid mechanism 52 is preferably a double electrical solenoid mechanism. The solenoid mechanism 52 preferably includes two push-type solenoids 31A and 31B. As shown in FIG. 3B, a stop 56B located on a side of the rotating drum 15 at or near the turnaround point 53A is utilized to actuate the reversing switch 32B so that the solenoid 31B pulls the cam roller 25 and the pump control lever 20 towards the solenoid 31B to travel downward within the cam roller groove 26, beginning the up-stroke or down-stroke. A corresponding stop (not shown) is located on the opposite side of the rotating drum 15 at or near the turnaround point 53B (see FIG. 3). In the same manner as described above in relation to the stop 56B and switch 32B, at or near the turnaround point 53B, the switch 32A comes into contact with the stop (corresponding stop not shown), thereby activating the solenoid 31A which pulls the cam roller 25 and the pump control lever 20 towards the solenoid 31A to travel downward within the cam roller groove 26 to begin the up-stroke or down-stroke. While the cam roller 25 and pump control lever 20 are traveling through the inter-cyclic portions 55A, 55B of the cam roller groove 26, neither reversing switch 32B, 32A is activated until one of the stops 56B, (not shown) comes into contact with its corresponding reversing switch 32B, 32A.

Referring specifically to FIGS. 3A and 3B, each solenoid 31A, 31B typically includes a solenoid coil 45A, 45B surrounding a moveable actuator such as a plunger 46A, 46B. A connecting member such as a push pin 47 usually connects the plungers 46A and 46B to one another. In the embodiment shown in FIGS. 3A and 3B, the push pin 47 is also connected to the cam roller 25 so that the movement of the plunger 46A, 46B in a direction causes the push pin 47 to move in that direction, thereby forcing the cam roller 25 and pump control lever 20 to move in that direction.

The operation of solenoids is known by those skilled in the art. Generally, one of the solenoid coils 45B, 45A may be energized by an electric current (when the stop 56B, (not shown) contacts the designated reversing switch 32B, 32A), creating a magnetic force which causes the plunger 46B, 46A to travel in a direction within the coil 45B, 45A. The solenoid 31B, 31A loses its magnetic force when input electric power is removed (when the stop 56B, (not shown) is not in contact with the corresponding reversing switch 32B, 32A).

Figure 4:
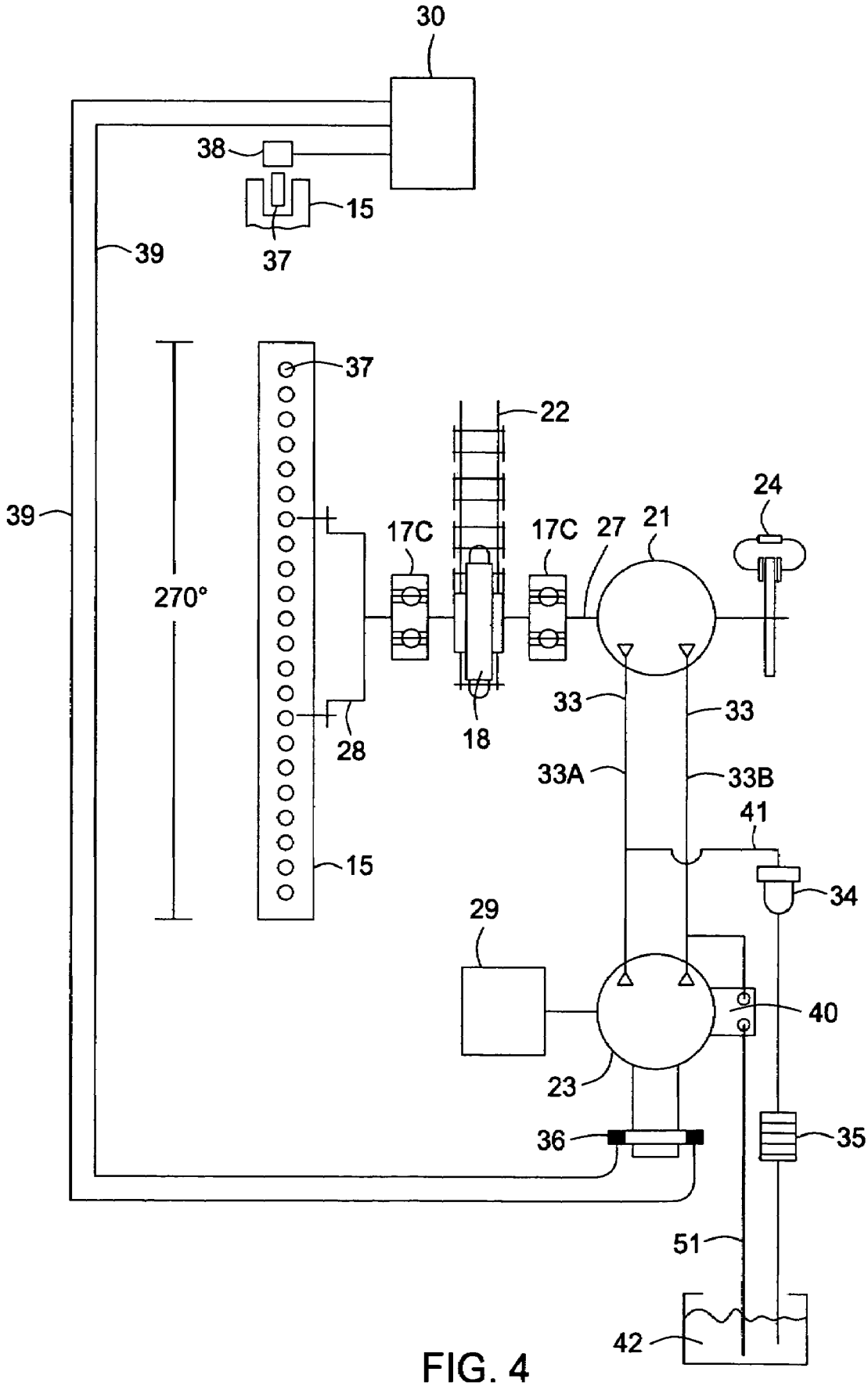
FIG. 4 is a perspective view of an electrical control system for the drive mechanism of FIGS. 1-2.
Figure 5A:
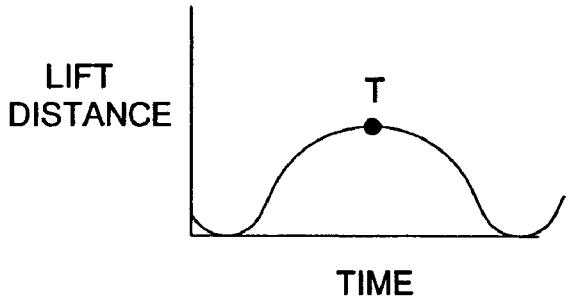
FIG. 5A is a graph of rod string motion during a rod string cycle of a prior art beam pump drive mechanism.

FIG. 4 shows the electrical control system for use in embodiments of the present invention to control the speed, acceleration, and direction of movement of the polished rod 11 of the drive mechanism 5. The electrical control system may be utilized in conjunction with or in lieu of the mechanical control system shown and described in relation to FIGS. 1-3B.

Because of its similarity to portions of the drive mechanism having the mechanical control system shown and described in relation to FIGS. 1-3B, like parts of the drive mechanism having the electrical control system shown in FIG. 4 are labeled with the same numbers as like parts of portions of the drive mechanism having the mechanical control system of FIGS. 1-3B. Therefore, the above description of the parts and their method of use relating to embodiments of the drive mechanism of FIGS. 1-3B applies equally to the parts of the drive mechanism embodiment of FIG. 4 which are labeled with the same numbers.

Referring to FIG. 4, instead of the cam roller groove 26 in the rotating drum 15 and the pump control lever 20 with the cam roller 25 thereon controlling the drive mechanism 5 as in FIGS. 1-3B, an electrical pump control 36 controls the fluid introduced through the closed loop circuit 33 by the hydraulic pump 23 to the drive motor 21. The electrical pump control 36, which is operatively connected to the hydraulic pump 23, determines the fluid flow rate and direction of fluid pumped to the drive motor 21 by the hydraulic pump 23.

The electrical pump control 36 is in electrical communication with a computer processor 30 by a pump control circuit 39. The computer processor 30 is, in turn, in electrical communication with one or more sensors 38, preferably one or more magnetic sensors. One or more magnets 37 are located in the rotating drum 15 at intervals from one another. Preferably, approximately twenty-five magnets are located in the rotating drum at intervals equal to approximately one magnet for each foot of stroke length over the preferred approximately 270-degree distance of rotating drum 15 rotation. The magnets 37 are preferably, but not necessarily, permanent in nature. The magnets 37 preferably rotate along with the rotating drum 15.

The magnets 37 are capable of transmitting one or more signals to the sensor 38. The sensor 38 transfers the one or more signals to the computer processor 30, which then sends pre-programmed control signals to the electrical pump control 36 through the pump control circuit 39. The electrical pump control 36 then determines the fluid flow rate and direction of the fluid being pumped through the closed loop circuit 33 by the hydraulic pump 23 to the drive motor 21. In embodiments of the electrical control system, the magnets 37 and magnetic sensor 38 may be substituted with any type of sensing mechanism capable of transmitting a signal to a computer processor.

In the above description, the drive mechanism 5 includes bearings mechanisms 17A, 17B, and 17C. Any or all of the bearings mechanisms 17A, 17B, 17C may be substituted with one or more bushings or any other mechanism known to those skilled in the art which facilitates rotation of an object relative to an attached surface.

In the operation of the mechanically controlled drive mechanism embodiment shown in FIGS. 1-3B, the power 29 is initially activated. The power 29 preferably rotates in one direction to power the drive mechanism 5. Activating the power 29 causes the hydraulic drive (which includes the hydraulic pump 23 and the drive motor 21) to commence operation. The hydraulic drive provides the driving force for the drive mechanism 5, and the amount of force the hydraulic drive puts forth to move the rod string 11 is determined by the mechanical control system.

The hydraulic pump 23 preferably rotates in the same direction as the power 29 and only in one direction. In contrast, the drive motor 21 rotates in both directions, as the drive motor 21 is disposed on the same drive shaft 27 as the drive sprocket 18 which manipulates the upward and downward movement of the rod string 11 within the wellbore. The direction of movement (up or down) of the drive motor 21 (and therefore the rod string 11) is determined by the predetermined pattern of the cam roller groove 26 in the rotating drum 15. Additionally, the predetermined pattern of the cam roller groove 26 determines the flow rate of fluid pumped into the drive motor 21 through the closed loop circuit 33 by the hydraulic pump 23, which dictates the inter-cyclic speed of the rod string 11 and the turnaround points 53A, 53B of the rod string 11.

The pattern of motion of the rod string 11 is automatic upon turning on the power 29. As mentioned above, the hydraulic pump 23 begins to introduce fluid into the drive motor 21, beginning the automatic cycling of the drive mechanism 5. At this point, the speed of rotation and direction of rotation of the drive motor 21 and its drive shaft 27 dictate the speed of the rod string 11 during the up-stroke or down-stroke and the direction of the rod string 11 (upward or downward). The speed of rotation of the drive motor 21 and drive shaft 27 is dictated by the rate of fluid flow from the hydraulic pump 23 into the drive motor 21. The rate of fluid flow from the hydraulic pump 23 into the drive motor 21 is dictated by the slope of the predetermined pattern on the cam roller groove 26. The direction of rotation of the drive motor 21 and drive shaft 27 is determined by the predetermined pattern on the cam roller groove 26 and the direction the solenoid mechanism 52 manipulates the cam roller 25 within the cam roller groove 26, and ultimately whether the cam roller 25 is traveling upward or downward within the cam roller groove 26.

A preferred embodiment of a pattern of the cam roller groove 26 on the rotating drum 15 is shown in FIG. 3. The preferred embodiment includes merely one example of inter-cycle speed control of the rod string 11 possible with the drive mechanism 5 of the present invention. In one embodiment, the cam roller 25 is at rest at the turnaround point 53B initially with the rod string 11 at its lowermost point within the wellbore.

When the cam roller 25 is at this turnaround point 53B, there is no fluid flow from the hydraulic pump 23 into the drive motor 21, and the drive motor 21 and drive shaft 27 are at rest. In the preferable embodiment, when the pump control lever 20 is substantially centered on the rotating drum 15 and therefore substantially perpendicular to an axis of the hydraulic pump 23, which occurs when the cam roller 25 is at one of the turnaround points 53A or 53B, there is no fluid flow from the hydraulic pump 23 to the drive motor 21; therefore, the rod string 11 is at rest when the pump control lever 20 is centered on the rotating drum 15. Fluid flow from the hydraulic pump 23 gradually increases as the pump control lever 20 pivots to the left or to the right from the center of the rotating drum 15 by the cam roller 25 moving through the cam roller groove 26.

At the turnaround point 53B, the stop (not shown) on the side of the rotating drum 15 contacts the reversing switch 32A, so that the solenoid 31A pulls the cam roller 25 towards the solenoid 31A. This initial pull of the solenoid 31A provides the force to initiate the movement of the cam roller 25 through the inter-cyclic portion 55A of the cam roller groove 26. The cam roller 25 first travels through portion A of the cam roller groove 26. Portion A is sloped so that the speed of the rod string 11 constantly increases during the upstroke. Portion A, with respect to a line through the turnaround point 53B coaxial with the rotating drum 15, gradually slopes upward at an angle until it reaches portion B. The slope of portion A takes into account the gradual increase in speed desired to prevent breaking, stretching, or otherwise damaging the rod string 11 when initializing the up-stroke of the rod string 11 (necessary due to the high load on the rod string 11 during the initial up-stroke caused by the previous inactivity of the rod string 11 in combination with the weight of the rod string 11 and the weight of the fluid which is being lifted during the up-stroke). Because the rate (also volume of fluid introduced over time) of fluid introduced into the drive motor 21 directly corresponds with the slope of portion A (because the pump control lever 20 connects the cam roller 25 to the hydraulic pump 23), the flow rate of fluid pumped to the drive motor 21 gradually and constantly increases from zero flow rate at the turnaround point 53B to full speed at the juncture between portion A and portion B.

The maximum preset flow rate of fluid from the hydraulic pump 23 to the drive motor 21 is reached at the juncture between portion A and portion B during the up-stroke, as at this juncture the pump control lever 20 is pivoted to its farthest point from the center of the rotating drum 15. The maximum preset flow rate of fluid from the hydraulic pump 23 is maintained during portion B of the up-stroke because portion B is at a ninety-degree angle with respect to a line through the turnaround point 53B drawn from one side of the rotating drum 15 to the other side. This maximum preset flow rate is maintained as the cam roller 25 travels through the maximum-sloped portion B for a predetermined period of time, as determined by the predetermined length of portion B. Thus, the maximum speed of the rod string 11 is maintained by the flow rate of hydraulic fluid through portion B during the up-stroke.

Before reaching the turnaround point 53A between the up-stroke and the down-stroke, the rod string 11 is gradually decelerated from its maximum speed to its stopping point between the up-stroke and down-stroke to prevent damage to the rod string 11 such as stretching or breaking caused by abrupt stopping of inertia of the rod string 11 at the end of the up-stroke. To provide the gradual deceleration of the fluid flow from the hydraulic pump 23 and thus the gradual deceleration of the rod string 11 at the end of the up-stroke, portion C is sloped towards the center of the rotating drum 15 from the juncture between portions B and C to the turnaround point 53A. As the cam roller 25 travels through portion C, the flow rate of fluid from the hydraulic pump 23 to the drive motor 21 is constantly decreased proportional to the slope of portion C, thus reducing the speed of movement of the rod string 11 during the up-stroke. Preferably, the slope of portion C is different than the slope of portion A, but any slope of portions of the cam roller groove 26 may be utilized in embodiments of the present invention which produces the desired motion pattern for the rod string 11.

When the cam roller 25 reaches the turnaround point 53A, the rod string 11 is temporarily at rest at its uppermost point, between the up-stroke and the down-stroke of the rod string 11. As the stop 56B contacts the reversing switch 32B, the solenoid 31B pulls the cam roller 25 past the steady state, turnaround point 53A to induce motion of the rod string 11, initiating the down-stroke.

For the down-stroke, hydraulic fluid flow is constantly increased from the hydraulic pump 23 to the drive motor 21 according to slope of portion D as the cam roller 25 travels through portion D. The rate of movement of the rod string 11 constantly increases in direct proportion to the flow rate of the hydraulic fluid. The flow rate thus changes from zero flow rate at the turnaround point 53A to the maximum preset reverse flow rate at the juncture between portion D and portion E, and the rod string 11 correspondingly increases in speed from stopped to maximum speed through portion D.

The maximum flow rate of fluid from the hydraulic pump 23 continues as the cam roller 25 moves through portion E; therefore, the rod string 11 continues at the maximum predetermined speed at this point in the cycle for a predetermined time, as dictated by the length of portion E. When the cam roller 25 reaches portion F, the flow of hydraulic fluid from the hydraulic pump 23 gradually decreases in rate proportional to the slope of portion F, causing the rod string 11 speed to gradually decrease at the end portion of the down-stroke movement. The rod string 11 speed decreases from its maximum speed at the junction between portions E and F to no speed as its movement halts at the turnaround point 53B. Another cycle of the rod string 11 may be initiated by activation of movement of the cam roller 25 into portion A by the solenoid 31A, as described above, so that the rod string 11 automatically repeats the motion pattern dictated by the cam roller groove 26. The cam roller 25 repeats movement through the motion profile until power 29 is halted or the brake 24 is activated.

Therefore, the preferred rod string motion profile produced by embodiments of the present invention includes slowly increasing speed of the rod string on the up-stroke to full speed, having a turnaround which lasts for a sufficient amount of time, and increasing to full speed on the down-stroke. Embodiments of the rod string motion profiles of the present invention may include a slow up-stroke and fast down-stroke. Alternatively, embodiments may include a fast up-stroke and slow down-stroke. The rod string motion profile may be altered depending upon the viscosity of the fluid which is being lifted from the wellbore. If the fluid has a high viscosity, it is often desirable to induce a motion profile having a slower down-stroke than up-stroke because only gravity is pushing the rod string down into the heavy fluid in the wellbore. The rod string profile of embodiments of the present invention may be easily altered to fit the desired cyclic motion of the rod string. The inter-cyclic rod string speed may be changed to produce desirable motion profiles that produce desirable loading profiles.

The operation of the electrical control system embodiment shown in FIG. 4 with the drive mechanism 5 is similar to the operation of the mechanical control system embodiment. In the electrical control system embodiment, the cam roller groove 26, cam roller 25, and pump control lever 20 are replaced by the electrical control system. The pattern of movement, including the speed of movement as well as the direction of movement, of the rod string 11 is predetermined by a program within the computer processor 30 in the embodiment shown in FIG. 4.

As the control drum 15 rotates by fluid flow from the hydraulic pump 23 into the drive motor 21, the sensor 38 receives signals from the magnets 37. The sensor 38 transmits the signals to the computer processor 30, which then sends one or more pre-programmed control signals to the electrical pump control 36. The pump control 36 determines the fluid flow rate and direction of fluid pumped to the drive motor 21 by the hydraulic pump 23 according to the pre-programmed control signals sent by the computer processor 30. The electrical control system allows for the program to be changed within the computer processor 30 at the well site or at any location remote from the well site. Alternatively, the pattern or movement of the rod string 11 may be controlled by a timer controlling the application of fluid from the hydraulic pump 23 to the drive motor 21.

In the predetermined pattern of movement of the rod string 11 as dictated by the mechanical control system and/or the electrical control system, a pause may be placed in the down-stroke right before the turnaround of the rod string 11 to the up-stroke to lessen the stress of the transition to movement of the rod string 11. A pause may also be placed before the turnaround of the rod string 11 from the up-stroke to the down-stroke if desired.

During the cycle of the rod string 11, both inter-cycle and between cycles of the rod string 11, the quick responsiveness of the hydraulic drive as dictated by the cam roller groove 26 or the computer processor 30 decreases stress on the rod string 11 and allows precise control of the motion of the rod string 11 to increase overall speed of hydrocarbon fluid recovery. The mechanical counterbalance 14 decreases the amount of power necessary to drive the rod string 11 within and between cycles by counteracting the load of the rod string 11 and/or the load of the fluid being lifted by the rod string 11.

Figure 5C:
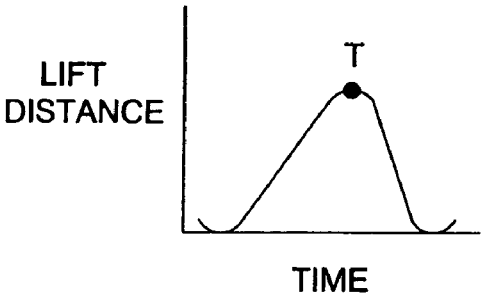
FIG. 5C is a graph of rod string motion during a rod string cycle using embodiments of the present invention.

FIG. 5C shows the rod string motion profile when using the drive mechanism 5 of embodiments of the present invention shown in FIGS. 1-4. The up-stroke of the rod string 11 is represented by the portion of the line to the left of turnaround point T, while the down-stroke of the rod string 11 is represented by the portion of the line to the right of the turnaround point T. The portion of the line representing the up-stroke of the rod string 11 shows the gradual increase in speed of the rod string 11 from the point of zero loading at the turnaround point between the down-stroke and up-stroke caused by the mechanical and/or electrical control system of the drive mechanism 5. The increase in the slope of the portion of the line representing the down-stroke of the rod string 11 delineates the faster speed of the rod string 11 during the down-stroke using the drive mechanism 5. Also evidenced in the rod string profile of FIG. 5C is the increased amount of time spent at the turnarounds of the rod string 11, as shown at the hills and valleys of the rod string motion profile curve.

Figure 6A:
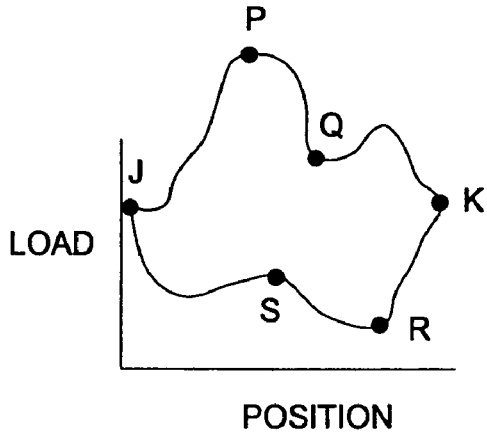
FIG. 6A is a dyno-card loading graph showing the loading on the rod string during a rod string cycle using the prior art beam pump drive mechanism.
Figure 5B:
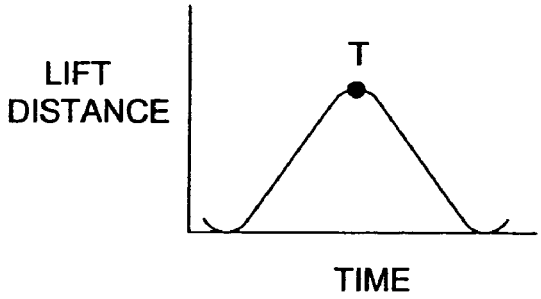
FIG. 5B is a graph of rod string motion during a rod string cycle of a prior art mechanical drive mechanism.
Figure 6B:
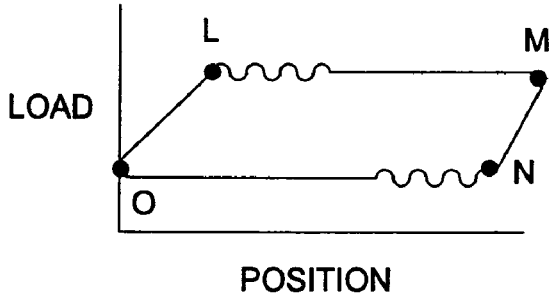
FIG. 6B is a dyno-card loading graph showing the loading on the rod string during a rod string cycle using the prior art mechanical drive mechanism.
Figure 6C:
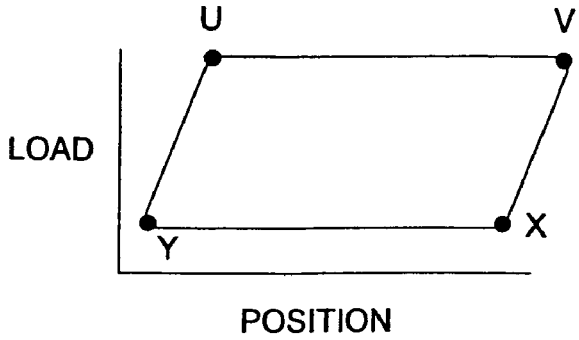
FIG. 6C is a dyno-card loading graph showing the loading on the rod string during a rod string cycle using embodiments of the present invention.

FIG. 6C illustrates the improvements in the loading to which the rod string 11 is exposed during the rod string 11 cycle using the drive mechanism 5 of FIGS. 1-4. The up-stroke of the rod string 11 is shown between the points U and V, while the down-stroke is shown between points Y and X. The turnarounds are shown between points U and Y (between the down-stroke and the up-stroke) and between points V and X (between the up-stroke and the down-stroke). The erratic loading of the beam pump system shown in FIG. 6A is substantially eliminated, as shown by the constant amount of loading on the up-stroke between points U and V and by the constant amount of loading on the down-stroke between points Y and X. Also, when using the drive mechanism 5 of embodiments of the present invention, the rod string 11 does not experience the unhealthy high loading thereon at, for example, point P of FIG. 6A, as is seen in FIG. 6C. Additionally, the undesirable jarring of the rod string 11 at the turnarounds between the up-stroke and down-stroke and vice versa experienced by the rod string of FIG. 6B does not occur when using embodiments of the drive mechanism 5 shown in FIGS. 1-4, as evidenced by the lack of undulations to the right of point U and to the left of point X.

Several advantages are gained by using embodiments of the drive mechanism 5 shown and described above in relation to FIGS. 1-4 to reciprocate a downhole positive displacement pump. Specifically, combining the hydraulic drive with mechanical counterbalancing reduces the hydraulic fluid needed to cycle the rod string 11 significantly. The necessary hydraulic fluid for cycling the rod string 11 may in some embodiments be reduced by as much as ⅔ by the mechanical counterbalancing of the mechanical counterbalance 14 along with the hydraulic drive of the hydraulic pump 23. The counterbalancing uses during the up-stroke the energy from the falling mass of the rod string 11 which is accumulated during the down-stroke. The counterbalance 14 alleviates the burden on the hydraulic pump 23 of lifting the load of the polished rod 11, so that only the work of lifting the well fluid is exerted by the hydraulic pump 23.

An additional advantage of the drive mechanism 5 is its dependability. First, the drive mechanism 5 is a dependable unit because the internal workings of the hydraulic drive are not exposed to the elements in the environment with each stroke of the rod string 11. Second, the drive mechanism 5 is a dependable unit because of the use of motion profiles of the mechanical and/or electrical control systems to control the rate and direction of fluid flow from the hydraulic pump 23 driving the drive motor 21.

Inter-cyclic speed control of the rod string 11 is provided by the electrical and/or mechanical control system. The quick responsiveness of the hydraulic pump 23 to the control system reduces stress on the rod string 11, thereby minimizing stretching and/or failure of the rod string 11, especially at the turnarounds of the rod string 11 cycle. Because of the inter-cycle speed control of the rod string motion during the cycles and at the turnarounds and because of the reduced time necessary to repair or replace broken or damaged rod strings, the overall speed of the pumping unit is ultimately increased by using the drive mechanism 5. Increasing the overall speed of the positive displacement pump allows increased production of hydrocarbon fluid from within the wellbore over a period of time, thereby decreasing the hydrocarbon fluid pumping costs of the well. In addition to the decreased pumping costs of the well caused by increased efficiency of the positive displacement pump brought about by the drive mechanism 5, the cost of the well is also decreased because the amount of replacement rod strings as well as the time required to repair rod strings is decreased due to the decreased number of occurrences and amounts of stress imparted on the rod string 11 by the drive mechanism 5 as compared to other drive mechanisms.

The drive mechanism 5 of embodiments of the present invention is highly responsive to speed changes due to less inertia of moving parts when changing speeds, as the hydraulic pump 23 runs at a constant speed. The change of speed and direction of the rod string 11 is not caused by the direction or speed of rotation of the hydraulic pump 23, but is instead determined by the hydraulic fluid flow rate from the hydraulic pump 23. The rotary drive motor 21 operating within the closed loop hydraulic circuit 33 is responsive to sudden speed changes of the rod string 11 because it has pressurized fluid on the inlet and outlet sides of the drive motor 21 that can act as a brake. With the drive mechanism 5 shown in FIGS. 1-4, it is possible to tailor inter-cycle speeds or the smoothness of the turnarounds of the polished rod 11 by modifying the rod string profile determined by the cam roller groove 26 or by the computer program within the computer processor 30.

Although the drive mechanism 5 shown and described herein in relation to FIGS. 1-4, 5C, and 6C is advantageous for use in a deep wells, it is also useful in other well pumping applications, such as in ordinary depth or shallow wells. Additionally, the drive mechanism 5 does not necessary have to be used in a long-stroke pumping unit, but may be used in a medium-stroke, short-stroke, or ultra-long-stroke pumping unit. In other embodiments, the drive mechanism 5 may be sized to operate under agricultural sprinkler irrigation systems.

Figure 7:
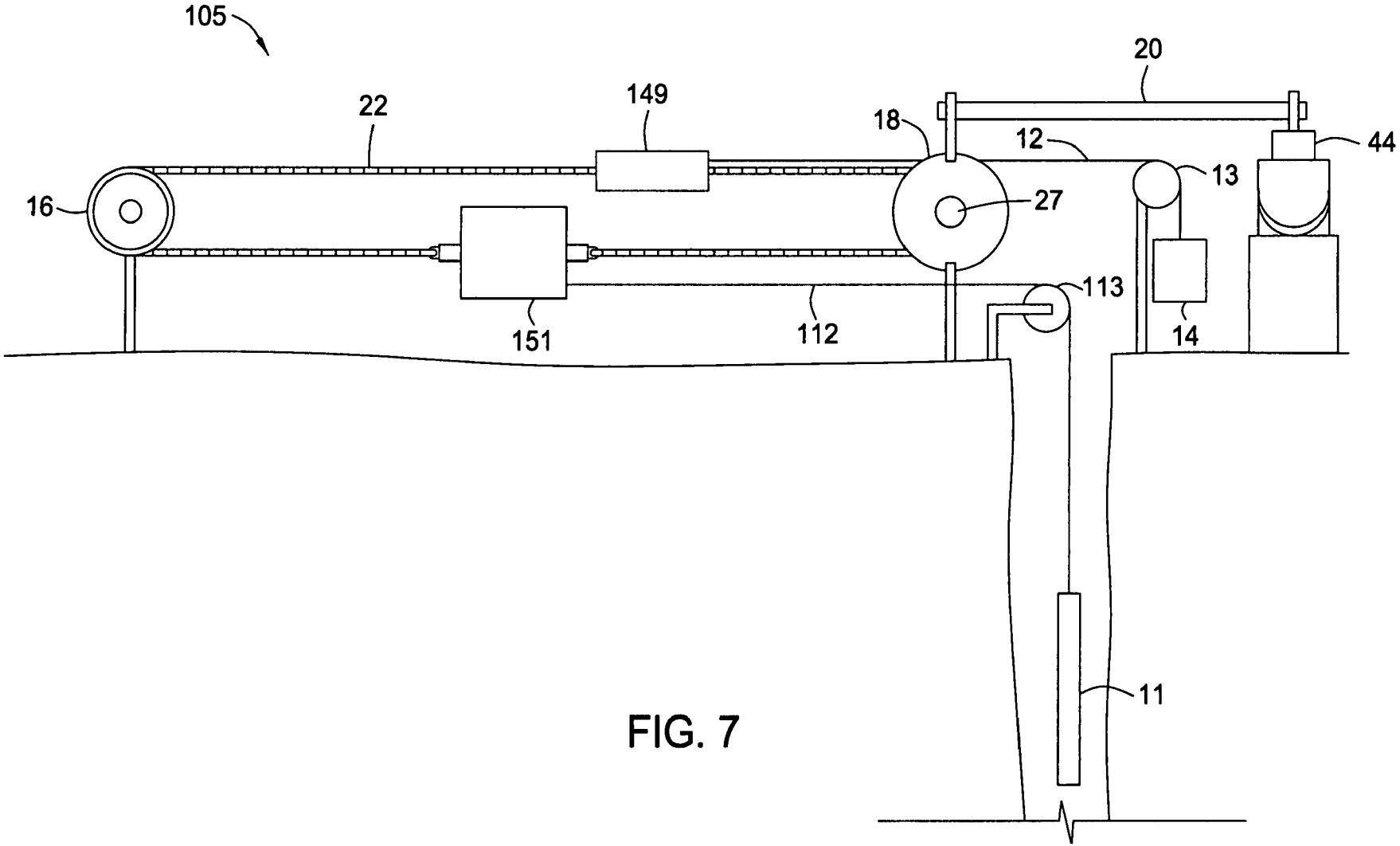
FIG. 7 is a side view of an alternate embodiment of a drive mechanism for a positive displacement pump.

FIG. 7 depicts an alternate embodiment of the present invention. To reduce the height profile of the drive mechanism above the surface of the earth relative to the height profile of the drive mechanism 5 shown in FIGS. 1-4, the drive mechanism is modified as shown in FIG. 7. Decreasing the height of the drive mechanism above the surface of the earth would allow other types of equipment such as pivot irrigation systems to exist above the drive mechanism.

The drive mechanism 105 shown in FIG. 7 is substantially the same in several respects to the drive mechanism 5 shown and described above in relation to FIGS. 1-3B. The sprocket/chain portion and the lift belt/lift pulley portion of the drive mechanism 5 shown and described above in relation to FIGS. 1-3B exist upright where the drive sprocket 18 and idle sprocket 16 exist generally coaxially with one another, and the idle sprocket 16 is located some height above the drive sprocket 18. In general, the counterbalance 14 provides counterbalancing force for the polished rod 11 due at least partially to gravity; therefore, the drive mechanism 5 cannot simply be turned on its side to lower the height profile of the drive mechanism 5.

In the embodiment shown in FIG. 7, the idle sprocket 16 is moved to a location close to the surface of the earth, and the rotational axis of the idle sprocket 16 is located at substantially at the same height above the surface as the rotational axis of the drive sprocket 18. The tower 19, as configured in FIG. 7, is eliminated and possibly replaced with a support structure having a lower height profile above the surface than the tower 19 to reduce the height of the drive mechanism 105 above the surface.

In other modifications from the embodiments shown in FIGS. 1-3B evident in the embodiment shown in FIG. 7, the counterbalance 14 is moved from its location within the chain 22. In its place, a first connector mechanism 149 exists. The first connector mechanism 149 is connected within the chain 22, and the lift belt 12 is also connected to the first connector mechanism 149 at a second end. The lift belt 12 travels over the pulley 13, but the location of the pulley 13 is moved as shown in FIG. 7 so that the pulley 13 is disposed underneath the top of the lift belt 12 (the top as shown in FIG. 1). Instead of the polished rod 11, the counterweight 14 is connected to the first end of the lift belt 12. In this arrangement, gravity may act on the counterweight 14 to provide a clockwise-direction rotational force to the chain 22.

A second connector mechanism 151 is connected within a portion of the chain 22 across the idle and drive sprockets 16 and 18 from the first connector mechanism 149. A second end of a second lift belt 112 is connected to the second connector mechanism 151. The second lift belt 112 is disposed around a second lift pulley 113, and connected to a first end of the second lift belt 112 is the polished rod 11. The polished rod 11 is acted upon by gravity to provide a counterclockwise-direction rotational force to the chain 22.

The same components are located substantially parallel and coaxial to the drive sprocket 18 as shown in FIG. 7, but all components are located on the surface of the earth or on a support structure, and not on the tower 19. Additionally, in the mechanical control embodiment, the cam roller groove 26 (not shown in FIG. 7) is located at the upper end of the rotating drum 15 (essentially, the drum 15 is rotated approximately 45 degrees from the embodiment shown in FIG. 1). The pump control mechanism 44 is disposed beside the drive sprocket 18 so that the pump control lever 20 is capable of traveling through the cam roller groove 26.

The operation of the embodiment shown in FIG. 7 is substantially similar to the embodiment shown in FIGS. 1-3B, except that the counterbalancing force is provided by the counterbalance 14 in a different configuration and at a different location. Gravitational forces may act on the polished rod 11 and the counterbalance 14 during the operation of the drive mechanism 5.

In another embodiment, the same concept as shown and described in relation to FIG. 7 may be utilized with the electronic control embodiment shown in FIG. 4. The arrangement of similar components of the drive mechanism in the electronic control situation is the same as the arrangement of components of the drive mechanism 105, except that the cam roller groove 26 and pump control lever 20 are not present.

In either of the embodiments of the low height profile system or in any other embodiment of the present invention (e.g., embodiments shown in FIGS. 1-4), the counterweight 14 may be disposed underground and travel underground at any or all stages of the operation. Furthermore, in the low height profile system embodiments as well as in any of the embodiments shown and described above in relation to FIGS. 1-4, instead of the mechanical counterbalance 14, the counterbalance may be hydraulic. The hydraulic counterbalance may be an accumulator, the structure and operation of which is known by those skilled in the art. The accumulator would reduce the power required from the drive motor 21 to cycle the polished rod 11 as desired.

In some previously-existing drive mechanisms, the counterweight is attached by a carriage or mechanical reversing mechanism to the chain. Because of the arrangement of the above-shown and described embodiments of the present invention, the counterweight 14 may be directly attached to the chain 22 by bolting or some other means, as the carriage or mechanical reversing mechanism is not necessary.

In the electrical control embodiments of the present invention shown and described above, a hydraulic hose may be hooked up to connect the hydraulic pump 23 to the drive motor 21 to allow hydraulic communication between the two components. In this way, the electric motor 29 and the hydraulic pump 23 may be located at some location away from the wellbore to provide remote power to the drive mechanism 5, 105. This configuration reduces or eliminates the electrical components at the well site, providing a lower explosion risk and possibly allowing closer compliance with electrical regulations at the well site.

In any of the above embodiments, the brake 24 may be hydraulic instead of mechanical. This hydraulic brake would include one or more valves disposed in the hydraulic lines or hoses between the hydraulic pump 23 and the drive motor 21 in lieu of the mechanical brake 24. The valves may then act to stop rotation of the drive motor 21 and other components by closing off flow from the hydraulic pump 23 to the drive motor 21 if a system shut-down is desired (e.g., an emergency occurs which requires shut-down of the system). In addition to the valves or in the alternative, the swash plate within the hydraulic pump 23 may be switched to a position that would brake the system, eliminating the need for a separate brake 24 or valve within the hydraulic line or hose.

In any of the embodiments shown and described above espousing electrical controls, the sensors within the system may be used to detect the speed and/or location of the rod string 11 and alter the speed and/or location of the rod string 11 according to load on the rod string 11. Moreover, instead of the sensors 37 being located on the rotating drum 15, the sensors 37 may be located on the lift pulley 13, lift belt 12, a portion of the rod string 11, the counterbalance 14, or any other portion of the drive mechanism 5, 105 capable of detecting speed of movement and/or position of the rod string 11. The sensors 37 may be used to detect the speed and/or pressure of the drive motor 21 operation at any desired location on the drive mechanism 5, 105.

In lieu of the hydraulic pump 23 and the electric motor 29 shown and described above in relation to FIGS. 1-4 and 7 above, the drive mechanism 5, 105 may be powered by a piston pump or vein pump with a reversible variable speed electric motor. Alternately, the drive mechanism 5, 105 may be powered by multiple motors and pumps, including a combination of any of the types of motors and pumps described in the present application.

Embodiments of the present invention having an electrical control mechanism allow control, regulation, and modification of the stroke length and/or speed of the sucker rod 11 without having to change the gear reducer or cam profile within the rotating drum 15. Using electrical control mechanism embodiments eliminates the need to modify the rotating drum 15 due to wearing of the cam.

The size of the hydraulic pump 23 and/or electric motor 29 increases with increasing torque required to turn the drive sprocket 18. Increasing the size of the hydraulic pump 23 or electric motor 29 increases the expense of the components. To reduce the size of the hydraulic pump 23 and electric motor 29, one or more accumulators may be provided between the hydraulic pump 23 and the drive motor 21. Accumulators, used to store previously built up hydraulic energy until needed and then release the hydraulic energy to provide power, are known by those skilled in the art. The accumulator essentially pressurizes fluid to a volume to use the accumulated fluid pressure when needed for energy. Accumulators reduce the amount of horsepower needed to provide sufficient torque to the drive sprocket 18 because most of the horsepower is needed during the acceleration of the rod string 11, thereby reducing the size of the hydraulic pump 23 and electric motor 29 necessary. Power is expended during deceleration of the rod string 11. A solenoid valve may be utilized to open the accumulator when necessary to use the work recovered during deceleration in acceleration of the rod string 11.

While the foregoing is directed to embodiments of the present invention, other and further embodiments of the invention may be devised without departing from the basic scope thereof, and the scope thereof is determined by the claims that follow.

The invention claimed is:

1. A drive mechanism for a downhole, reciprocating positive displacement pump having a rod string, comprising:

a hydraulic drive comprising a variable flow hydraulic pump operatively connected to a reversible rotary drive motor;

a reciprocating counterbalance, and a rotating drum having a groove therein, the rotating drum rotatable at a proportionate rate to the drive motor and capable of determining a direction and rate of rotation of the drive motor which dictates the direction of movement of the rod string of the positive displacement pump, wherein the hydraulic drive is capable of dictating the pumping rate of the downhole positive displacement pump and the reciprocating counterbalance is capable of balancing a load on the rod string of the downhole positive displacement pump and the drive mechanism.

2. The drive mechanism of claim 1, wherein the pumping rate of the downhole positive displacement pump is determined by a flow rate of fluid in a closed-loop, hydraulic circuit that connects the hydraulic pump to the drive motor.

3. The drive mechanism of claim 2, wherein the flow rate of fluid is mechanically controlled.

4. The drive mechanism of claim 2, wherein the flow rate of fluid is electrically controlled.

5. The drive mechanism of claim 1, wherein the downhole rod string is reciprocatable within a cylinder by the drive mechanism.

6. The drive mechanism of claim 5, wherein a flow rate of fluid in a closed-loop circuit that connects the hydraulic pump to the drive motor determines a speed of movement of the rod string.

7. The drive mechanism of claim 6, wherein the hydraulic pump determines the flow rate of fluid within the closed-loop circuit.

8. The drive mechanism of claim 5, wherein the drive motor dictates the direction of movement of the rod string relative to the cylinder.

9. The drive mechanism of claim 1, wherein the rotating drum is operatively connected to the hydraulic pump by a lever, the lever capable of traveling through the groove to determine the direction and rate of rotation of the drive motor.

10. The drive mechanism of claim 1, wherein the reciprocating counterbalance is adjustable to dynamically counterbalance the load on the rod string and the surface drive mechanism.

11. The drive mechanism of claim 10, wherein the counterbalance is adjustable by adding or subtracting weight operatively attached across a pulley from the rod string of the positive displacement pump reciprocatable within a downhole cylinder.

12. The drive mechanism of claim 11, further comprising one or more strapping members rotatable around a pulley system which operatively connect the rod string to the drive motor.

13. The drive mechanism of claim 12, wherein the one or more strapping members move in a first direction and a second, opposite direction to reciprocate the rod string in a corresponding first direction and second direction.

14. The drive mechanism of claim 13, wherein the one or more strapping members comprise one or more belts.

15. The drive mechanism of claim 13, wherein the one or more strapping members comprise one or more chains.

16. The drive mechanism of claim 12, wherein the one or more strapping members are operatively connected to the counterbalance at a first end and operatively connected to the rod string at a second end.

17. The drive mechanism of claim 16, wherein the one or more strapping members are directly connected to the counterbalance at the first end.

18. The drive mechanism of claim 16, further comprising one or more counterbalance strapping members having first and second ends both operatively connected to the counterbalance.

19. The drive mechanism of claim 1, wherein the hydraulic pump is rotatable in only one direction and the drive motor is rotatable in two directions.

20. The drive mechanism of claim 1, further comprising one or more braking mechanisms capable of halting rotation of the drive motor.

21. The drive mechanism of claim 20, wherein the one or more braking mechanisms are hydraulic.

22. The drive mechanism of claim 20, wherein the one or more braking mechanisms comprises a swash plate disposed within the hydraulic pump.

23. The drive mechanism of claim 20, wherein the one or more braking mechanisms are one or more selectively closable valves disposed within one or more fluid-carrying lines connecting the hydraulic pump to the drive motor.

24. The drive mechanism if claim 1, wherein the hydraulic pump is disposed at a location remote from a remainder of the drive mechanism.

25. The drive mechanism of claim 1, wherein a closed-loop, hydraulic circuit connects the hydraulic pump to the drive motor.

26. A drive mechanism for a downhole, reciprocating positive displacement pump, comprising:

a hydraulic drive comprising a variable flow hydraulic pump operatively connected to a reversible rotary drive motor with a closed-loop, hydraulic circuit; and a reciprocating counterbalance; and a rotating drum having a groove therein, the rotating drum rotatable at a proportionate rate to the drive motor and capable of determining a direction and rate of rotation of the drive motor, wherein the hydraulic drive is capable of dictating the pumping rate of the downhole positive displacement pump and the reciprocating counterbalance is capable of balancing a load on a downhole rod string of the downhole positive displacement pump and the drive mechanism and wherein the downhole rod string is reciprocatable within a cylinder by the drive mechanism and wherein the direction of rotation of the drive motor dictates the direction of movement of the rod string relative to the cylinder.

27. The drive mechanism of claim 26, wherein the rotating drum is operatively connected to the hydraulic pump by a lever, the lever capable of traveling through the groove to determine the direction and rate of rotation of the drive motor.

28. A drive mechanism for a downhole, reciprocating positive displacement pump having a rod string, the drive mechanism comprising:

a hydraulic drive comprising a variable flow hydraulic pump operatively connected to a reversible rotary drive motor, wherein the hydraulic drive is configured to control the pumping rate of the downhole positive displacement pump;

a reciprocating counterbalance that is configured to balance a load on the rod string of the positive displacement pump and the drive mechanism; and a rotating drum having a groove formed therein, wherein the rotating drum is operatively connected to the hydraulic pump by a lever and wherein the lever is capable of traveling in the groove to determine a direction and rate of rotation of the drive motor which controls the direction of movement of the rod string of the positive displacement pump.

29. The drive mechanism of claim 28, wherein the pumping rate of the downhole positive displacement pump is determined by a flow rate of fluid in a closed-loop, hydraulic circuit that connects the hydraulic pump to the drive motor.

30. The drive mechanism of claim 29, wherein the flow rate of fluid is mechanically controlled.

31. The drive mechanism of claim 28, wherein the downhole rod string is reciprocatable within a cylinder by the drive mechanism.

32. The drive mechanism of claim 31, wherein a flow rate of fluid in a closed-loop circuit that connects the hydraulic pump to the drive motor determines a speed of movement of the rod string.

33. The drive mechanism of claim 32, wherein the hydraulic pump determines the flow rate of fluid within the closed-loop circuit.

34. The drive mechanism of claim 31, wherein the drive motor dictates the direction of movement of the rod string relative to the cylinder.

35. The drive mechanism of claim 28, wherein the reciprocating counterbalance is adjustable to dynamically counterbalance the load on the rod string and the surface drive mechanism.

36. The drive mechanism of claim 35, wherein the counterbalance is adjustable by adding or subtracting weight operatively attached across a pulley from the rod string of the positive displacement pump reciprocatable within a downhole cylinder.

37. The drive mechanism of claim 36, further comprising one or more strapping members rotatable around a pulley system which operatively connect the rod string to the drive motor.

38. The drive mechanism of claim 37, wherein the one or more strapping members move in a first direction and a second, opposite direction to reciprocate the rod string in a corresponding first direction and second direction.

39. The drive mechanism of claim 38, wherein the one or more strapping members comprise one or more belts.

40. The drive mechanism of claim 38, wherein the one or more strapping members comprise one or more chains.

41. The drive mechanism of claim 37, wherein the one or more strapping members are operatively connected to the counterbalance at a first end and operatively connected to the rod string at a second end.

42. The drive mechanism of claim 41, wherein the one or more strapping members are directly connected to the counterbalance at the first end.

43. The drive mechanism of claim 41, further comprising one or more counterbalance strapping members having first and second ends both operatively connected to the counterbalance.

44. The drive mechanism of claim 28, wherein the hydraulic pump is rotatable in only one direction and the drive motor is rotatable in two directions.

45. The drive mechanism of claim 28, further comprising one or more braking mechanisms capable of halting rotation of the drive motor.

46. The drive mechanism of claim 45, wherein the one or more braking mechanisms are hydraulic.

47. The drive mechanism of claim 45, wherein the one or more braking mechanisms comprises a swash plate disposed within the hydraulic pump.

48. The drive mechanism of claim 45, wherein the one or more braking mechanisms are one or more selectively closable valves disposed within one or more fluid-carrying lines connecting the hydraulic pump to the drive motor.

* * * * *